US006495762B2

(12) United States Patent
Arzate et al.

(10) Patent No.: US 6,495,762 B2
(45) Date of Patent: Dec. 17, 2002

(54) MULTIPURPOSE CABLE FOR OUTSIDE TELECOMMUNICATIONS

(75) Inventors: Fermin Marquez Arzate; Victor Osornio Osornio, both of Qro (MX)

(73) Assignee: Servicios Condumex S.A. de C.V., Qro (MX)

( * ) Notice: Subject to any disclaimer, the term of this patent is extended or adjusted under 35 U.S.C. 154(b) by 0 days.

(21) Appl. No.: 09/804,575

(22) Filed: Mar. 13, 2001

(65) Prior Publication Data

US 2002/0005291 A1 Jan. 17, 2002

(30) Foreign Application Priority Data

Jul. 11, 2000 (MX) ..... 006808

(51) Int. Cl.[7] ..... H01B 11/02
(52) U.S. Cl. ..... 174/113 R
(58) Field of Search ..... 174/113 R, 116, 174/27, 36, 103

(56) References Cited

U.S. PATENT DOCUMENTS 3,668,298 A * 6/1972 Hawkins ..... 174/113 R
5,519,173 A * 5/1996 Newmoyer et al. ..... 156/51

* cited by examiner

*Primary Examiner*—Chau N. Nguyen
(74) *Attorney, Agent, or Firm*—Carmen Pili Curtis

(57) ABSTRACT

Multipurpose cable for outside telecommunication of voice, video, data and distribution type (VVDD) composed of: a multipair construction core, electromagnetic shield elements and outside protective thermoplastic cover, characterized because it has a core composed of 2 to 600 twisted pairs of insulated electrical conductors, formed with close pairing lay lengths and reduced in the formation of said compounds pairs; a helicoidally wrapped plastic tape; a tape wrapping the assembled core; and an electromagnetic shield aluminum wrapping and outside insulating cover filled with jelly.

11 Claims, 3 Drawing Sheets

MULTIPURPOSE CABLE FOR OUTSIDE TELECOMMUNICATIONS

BACKGROUND OF THE INVENTION

1. Field of the Invention

The present invention relates to the development of outside plant cables to be used in Voice, Video, Data and Distribution (VVDD) type communications, and specially to telephone cables with larger bandwidth operation levels while maintain or preserve operation frequencies for voice transmission.

2. Previous Art

Currently, the telecommunication cables for interior use based on metal conductors with polyolefin insulation, formed into pairs and without shielding insulating them against electromagnetic interferences have had an accelerated development. Thus, they can currently work in frequencies ranging up to 250 MHz, according to the Nema WC 66-99 American Standard specification. Said cables are basically focussed on local area networks (LAN), houses, department buildings, or industrial structures, public buildings, intelligent buildings or school centers. This growth of local area networks has provoked that the users of digital services such as Internet, video on demand, high definition television, teleconferences, voice and fax services request telephone networks flexible enough to offer said services with a higher quality and faster transmission speeds compared to the ones handled currently in the outside plant telephone cables which have remained without important technical changes.

Innovations regarding telecommunication cables are known. For example, U.S. Pat. No. 5,739,473 describes a flame retardant telecommunication cable for office building use; said cable has a conductor array insulated in groups of twisted pairs and the insulation used in the core group is different from the insulation used in the surrounding groups. The main characteristic of this system is its structure and the use of a fluorinated copolymer. U.S. Pat. No. 4,319,071 describes a cable for telephone communication purposes with high multipair with small conductors the main characteristic of which is a liquid filling based on waterproof paraffin oils.

BRIEF DESCRIPTION OF THE DRAWINGS

Hereinbelow the invention is described according to the drawings of FIGS. 1, 1*a,* and 2, to 5, and 6*a, b, c*, wherein.

SUMMARY OF THE INVENTION

Figure 6C:
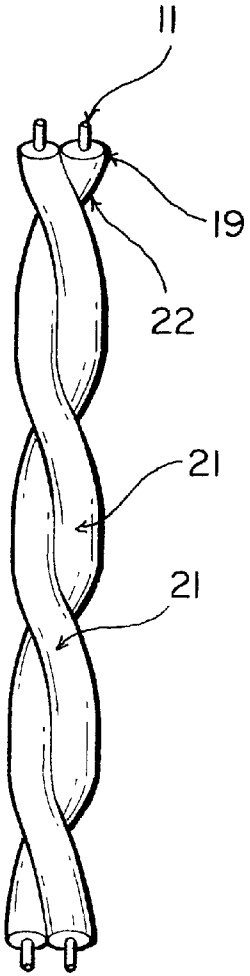
FIGS. 6*a,* b, c are a front view where the lay length differences are shown.
Figure 6B:
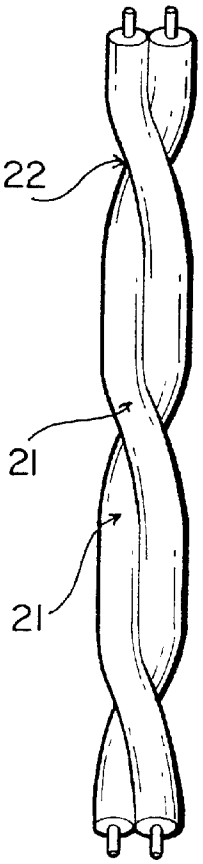

The applicant has developed a multipurpose telephone cable with larger bandwidth operation levels, from 0 to 100 MHz conserving the operation frequencies for voice transmission.

The cables object of the instant invention present an improvement regarding electromagnetic interference levels between adjacent pairs or between sectors or groups constituting the cable and multipair telecommunication cables are obtained with constructions containing from 2 to 600 pairs.

The geometric formation of the cables may vary depending on the final installation purpose. Said installation can be directly on the ground or in telephone ducts when they are rounded cables. In the case of air installations, the cable developed presents a mechanical support element that can be metallic or not. When the cable developed shows a reinforcement mechanical element, the final appearance of the cable will be in the shape of an "8", called self-supporting cable, to differentiate them from rounded cable.

The cable according to the instant invention is an electrically improved cable. Specially regarding its near end crosstalk (NEXT) values and electromagnetic interference level between groups. The interference level between adjacent sectors or groups of the same cable will generally have a minimum value of 9 db (decibels) in order to ensure an improved electric performance compared to the electromagnetic interference levels currently known in conventional telephone cables.

To improve the cable electric characteristics, "shorter" (maximized) pairing lays lengths are used, compared to conventional outside plant telephone cables. The length reduction of the pairing lay lengths provides the cable the capacity to work in a larger bandwidth because, with the reduction of pairing lay lengths a cable is obtained with better balanced pairs, minimizing thus the electromagnetic induction effects among pairs belonging to the same group and among pairs belonging to different groups (smaller number of disturbers). Thus said cable can used in transmission systems integrating services where better and larger transmission qualities at higher speeds are required, as well as pair multiplexion. Examples of services where said cables can be used are: ISDN (Integrated Service Digital Network), ISBDN (Integrated Service bandwidth Digital Network), XDSL (Digital Subscriber Line), and others.

The cable design contemplates diaphony values in operation frequencies up to 100 MHz.

The increase regarding the operation bandwidth of VVDD cables permits to increase the number of signals or transmissions circulating through the twisted pairs constituting the cable. The metal conductor used as core conductor in this type of cables presents a smooth and uniform surface finishing as well as a constant diameter. These characteristics contribute globally to provide the cable with better attenuation and increased impedance values, which are important factors in the performance of the electric cable. In the same way, the insulated material extruded on the core conductor presents 10% maximum eccentricities with regard to the total of insulated conductors. This, in turn, contributes to obtain better mutual capacitance values, and has a positive impact on the final results, especially at (NEXT) electromagnetic interference level between adjacent pairs in the same group or between pairs of different groups or sectors in the finished cable.

The improvements mentioned together with the maximized pairing lay lengths (with narrow tolerances), plus the random assembly of the pairs and the final cabling of the groups or sectors, combine to give as a result a VVDD telecommunication cable with improved electrical performance.

This means that the component twisted pairs of the cable present a better dimensioning throughout its length and lesser mechanical abuse during the manufacturing process. This, in turn, originates as a global result the lowering of electromagnetic interference levels (NEXT) among pairs, sectors or groups of a given cable, providing a cable that can operate within a wider frequency range (0–100 MHz).

The proposed cables reported in this document are classified in two types:

1) Dry core cables. In this type of cables there is no filling material between the components or conductors constituting the finished cable.
2) Filled core cables. Those are cables in which there is a filling material known as jelly, which can be a petrolatum or an extended thermoplastic rubber (ETPR), which is placed between different pairs constituting the cable core. Besides, in this type of cable, there is also a flooding compound between the cable shield and the outside cover.

DETAILED DESCRIPTION OF THE INVENTION

Figure 6A:
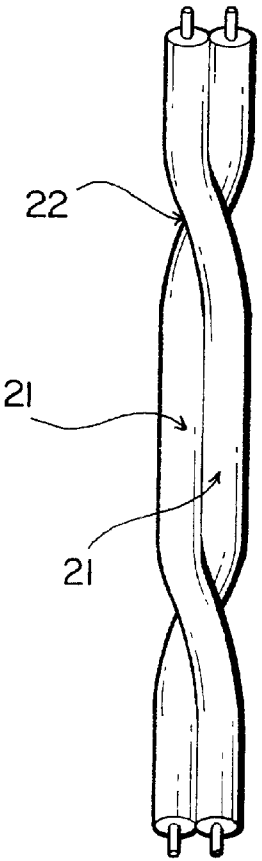
Figure 1:
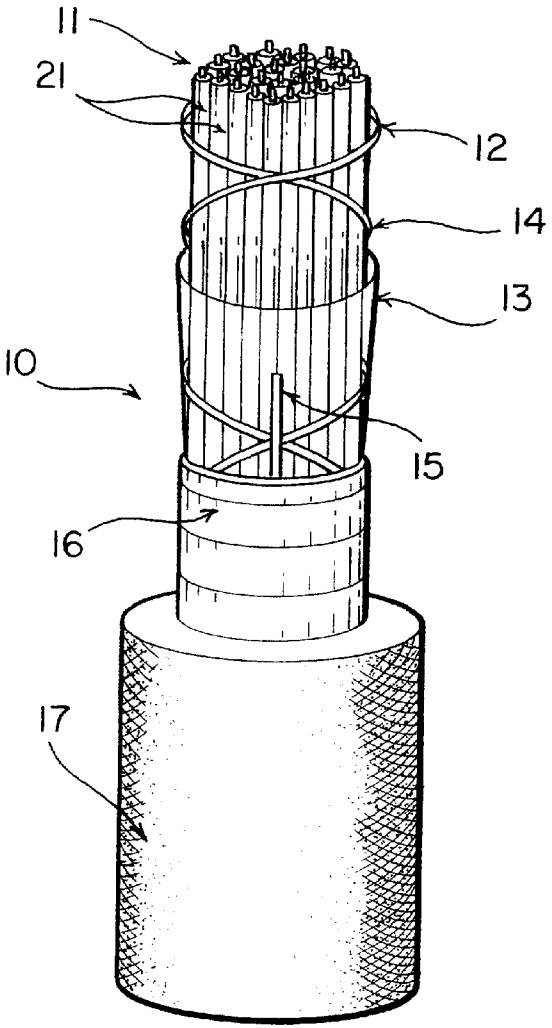
FIG. 1 is a front view with cross section showing the different sections constituting the multipurpose cable for outside telecommunications.
Figure 1A:
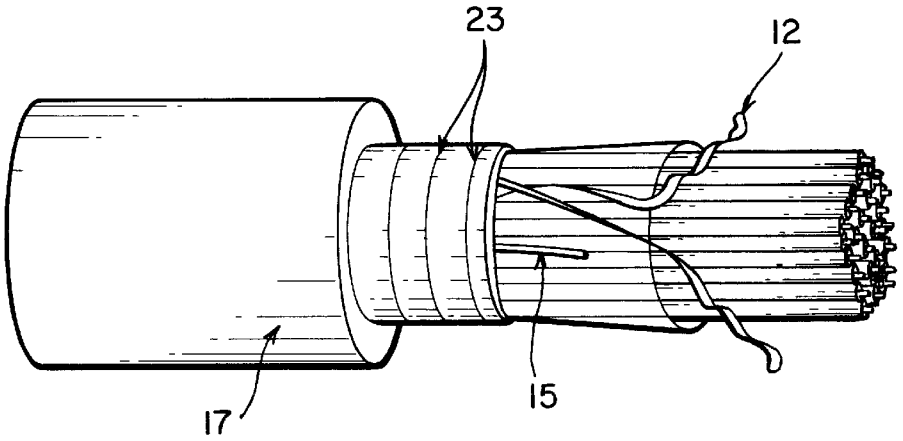
FIG. 1*a* is a cross section view of FIG. 1 showing the placement of the multipair construction of the cable core and sections.
Figure 2:
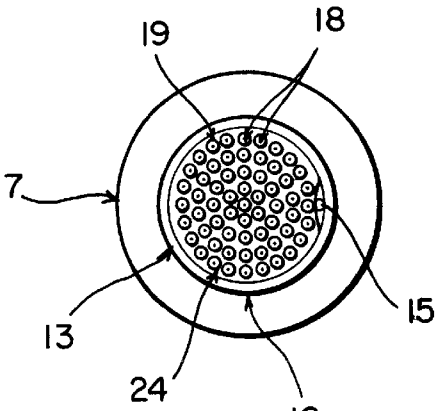
FIG. 2 is a cross section view the cable showed in FIG. 1.
Figure 5:
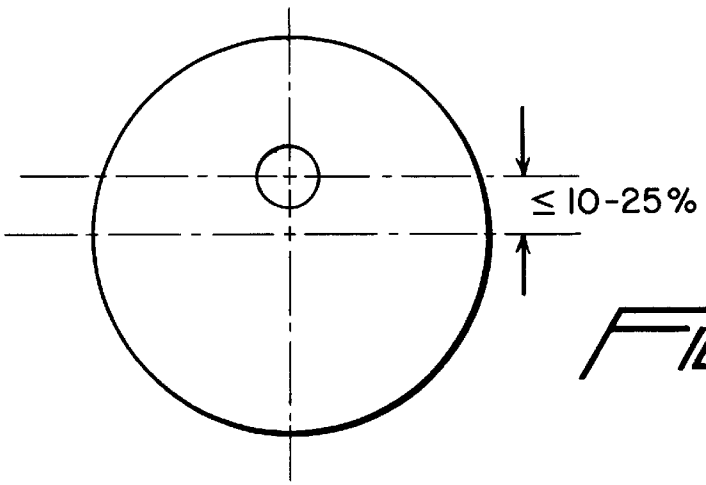
FIG. 5 is a sketch showing the maximum permitted eccentricity grade.
Figure 3:
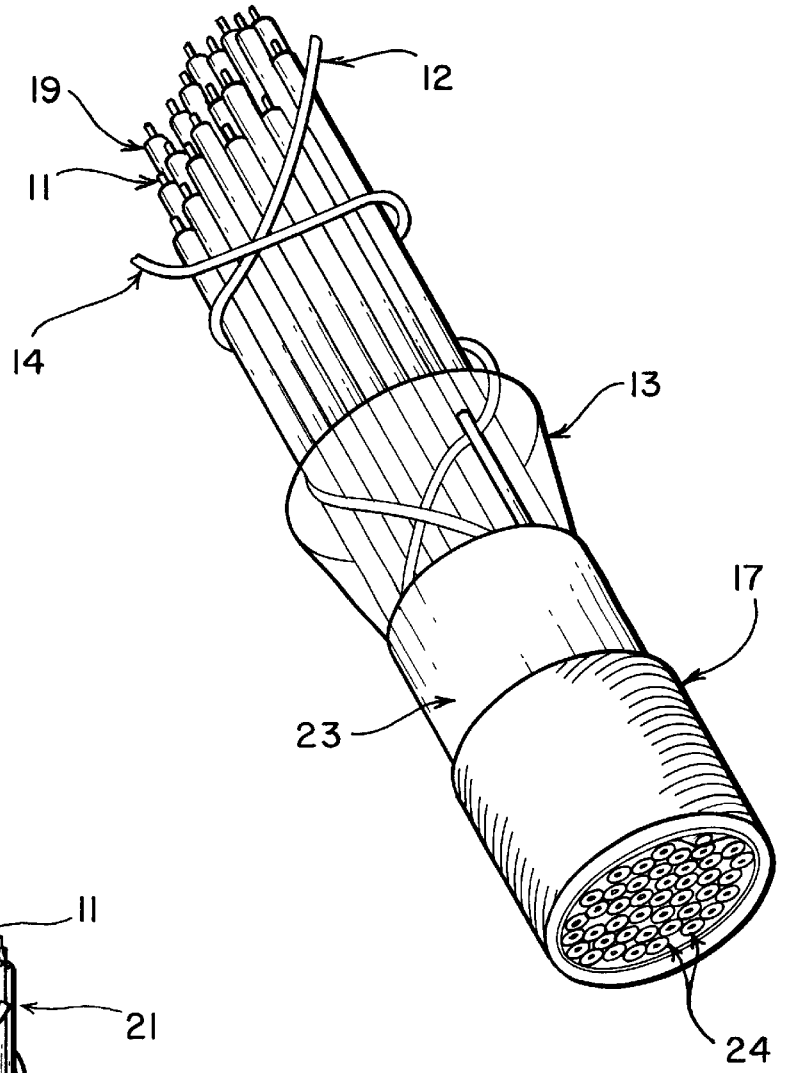
FIG. 3 is an exploded isometric view of FIG. 1 showing the multipair groups in their different grouping forms.
Figure 4:
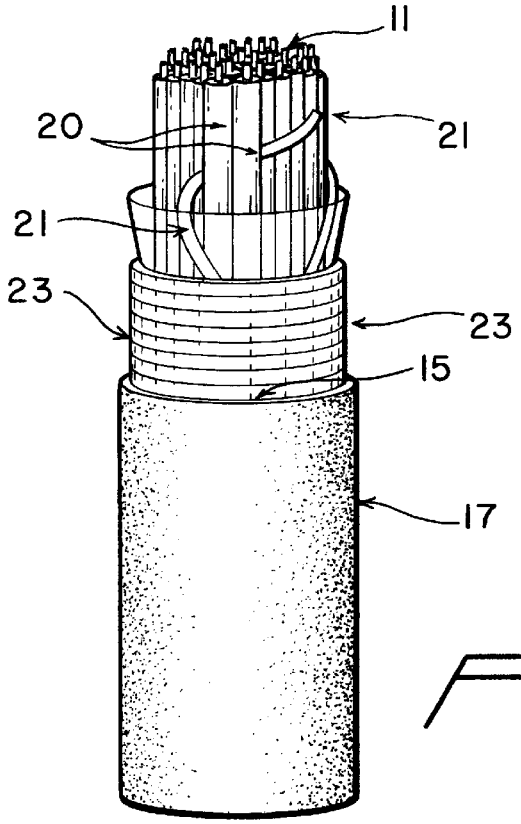
FIG. 4 is a front view of the multipair construction of the jelly flooded core.

The multipurpose cable for outside telecommunications 10 FIG. 1 object of the instant invention shows a practically solid cylindrical section, i.e., without interstices, because of the shape of the union of conductor pairs. Said cable consists of the following pairs: a plurality of metallic electrical conductors 11, for telecommunications, as the main core of the outside plant cable 10, in 19, 22, 24 and 26 AWG gauges, insulated with a polyolefinic material plastic layer 19, FIG. 2, presenting a minimum conductor eccentricity, FIG. 5. Said core is characterized by constructions from 2 to 600 twisted pairs 21 FIG. 4, formed with optimized lay lengths different among them, FIGS. 6*a, b, c* 22 and components of the groups or sectors of the finished cable. It is thus possible to reduce the electromagnetic interference level (NEXT in db). This is obtained making a careful selection of the pairing lay lengths involved and a random assembly of the pairs to form finally the groups or sectors 20, FIG. 4, of cable components 10 FIG. 1.

One additional important factor to obtain superior electric result is the fact that the tolerances of the pairing lay lengths in the pairs are maintained within a minimum variation range (generally ±1 mm). Thus, if during the random assembly, pairs of similar pairing lay lengths are in contact, transmission area invasion phenomenon with the consequent generation of electromagnetic induction is not produced; a plastic tape for the union 12 and 14 of the arrays of pair sectors 21; a plastic wrapping tape 13, as the assembled core fastening element; a rupture thread 15, longitudinally projected along the cable 10; an aluminum wrapping tape 16, concentrically placed with regard to the core with corrugated or smooth outside or inside walls 23 to inhibit the entry or exit of electromagnetic radiation, an insulated outside cover 17 based on low and medium density polyolefins, and, eventually, jelly filling flooding all the interstices 24 of the cable core and reinforcement elements.

Manufacturing Process of the Multipurpose Cable for Outside Telecommunications

The basic parts constituting the multipurpose cable of the instant invention, according to the figures of the drawings are as follows:

Metal conductor 11, FIG. 1, softly tempered, 19, 22, 24 and 26 AWG gauges, with solid or foam polyolefin insulation 19 with solid layer protection, with adequate thickness to fulfill the requested electrical parameters;

Assembling elements 12, 14 to fasten and identify the different sectors or groups of twisted pairs conforming the complete cable;

Dry core or filled core. The function of the filling material is to prevent humidity penetration to the cable core. On the dry or filled core a plastic wrapping tape made of non hygroscopic material is applied 13 (transparent layer).

Shield 23, according to the case. This component is usually applied in a smooth or corrugated longitudinal way. In case of filled cables, a flooding compound is usually applied between the shield and the outside cover, in order to reduce the corrosion of the metal materials involved.

Outside cover 17, material based on low or medium density polyolefins.

Manufacturing Process

Cable manufacturing is conducted through the following steps:

a) tandem process, wherein the copper wire passes through a series of drawing dies, where it is submitted to successive cross section area reductions to obtain the design final diameter (19, 22, 24, 26 AWG). In this same step, the central conductor, already in is final dimension, is annealed to change its temper from hard to soft, obtaining thus minimum 15% elongations;
b) after the material is annealed, it is led toward an extrusion machine in which the wire passes through an extrusion head, in which the guide and extrusion dies are located. This is the part that gives its final diameter to the insulation. Said dimensioning occurs when the solid or foam insulating material with solid layer protection is extruded from the existent extruder on the process line towards the extrusion dies. At this stage, the eccentricity level between the metal conductor and the insulation applied is also 10% maximum.

The step of pairing VVDD cables with fewer than 10 pairs is conducted separately and then the pairs are cabled to provide the final configuration. The pairing and cabling steps are selected in such way that the electromagnetic induction (NEXT) between pairs of groups or between different groups or sectors is minimized, obtaining thus a superior electrical performance, specially with regard to NEXT. In the step of pairing-cabling cables with a number of pairs equal or greater than 10, the insulated conductors are assembled in pairs with pairing lays optimized to ensure a high electrical performance of the cable, specially regarding the NEXT parameter between pairs of the same group or between pairs of different groups or sectors. After forming the pairs, said pairs are grouped in sectors of 10 pairs, in the case of cables of up 100 pairs or in groups (5 sectors of 10 pairs) of 50 pairs in the case of cables consisting of 150 to 600 pairs. Sectors or groups are guided through assembling devices to be cabled and to form the core final assembly. In the case of filled cables, it is in this step when the cable core is impregnated with the filling material (jelly) through an immersion process ensuring thus core waterproofing. The application of an outside cover based on low and medium density polyolefins is also conducted in an extruder, using for this purpose extrusion guides and dies according to the final dimensions of the cable. In the case of filled cables, it is in this operation that, before the application of the outside cover, the shielded core is impregnated with a flooding compound, the function of which is to prevent humidity penetration inside the cable and reduce the corrosion of metal elements such as shield or armor.

What is claimed is:

1. A multipurpose cable for outside telecommunications of video, video, data and distribution type (VVDD), consisting of: a multipair construction core; electromagnetic shielding elements and protective outer thermoplastic cover, characterized because the core is integrated by 2 to 600 twisted pairs, of insulated electric conductors formed with close pairing lay lengths and formed into pair sectors; a plastic tape helicoidally and longitudinally placed to join the pair sectors together forming the core; a plastic wrapping tape covering concentrically said core; a rupture thread longitudinally projecting along the cable, and on the outer cover thereof, and an aluminum wrapping tape placed tubularly as electromagnetic shielding element, a low, said outer cover made of and medium density polyolefin; and a jelly filling covering the core interstices; and an additional jelly film applied between the outer cover and the shield element.

2. The multipurpose telecommunication cable for outside plant use according the claim 1, characterized because the insulated electric conductors are metal copper conductors of 19, 22, 24 and 26 AWG gauges, insulated with a polyolefin material plastic layer in which each of the metal conductor shows a minimum eccentricity with regard to the dimensioning of the final diameter of the insulating layer of 10% maximum.

3. The multipurpose telecommunication cable for outside plant use according the claim 1, characterized because the lay of the pairs is practically closed between lays and presenting thus a major length reduction of the lay lengths, which is obtained through a random assembly of the pairs forming the groups or sectors constituting the multipair cable construction.

4. The multipurpose telecommunication cable for outside plant use according the claim 3, characterized because the lay length reduction in the pair components is about 45% lower than in conventional outside plant telephone cables.

5. The multipurpose telecommunication cable for outside plant use according the claim 3, characterized because the lay length reduction offers a close pairing lays allowing the lowering of magnetic interference levels.

6. The multipurpose telecommunication cable for outside plant use according the claim 3, characterized because the pairing lays are within a minimum variation average of about 1 mm, to avoid a possible electromagnetic induction.

7. The multipurpose telecommunication cable for outside plant use according to claim 1, characterized because said cable permits to improve the NEXT levels in an electromagnetic induction of 9 db and can operate in 0–100 MHz frequencies of a greater bandwidth.

8. A manufacturing method for the multipurpose cable for outside telecommunications of claim 1, characterized because of the following steps: a) tandem process, in which copper wire of each insulated electric conductor passes through a series of drawing dies, in which it is submitted to successive cross section area reductions to 19, 22, 24, 26 AWG gauge; in this same step, the dimensioned central conductor is annealed each change its temper from hard to soft, at 15% minimum elongations; b) each annealed conductor is guided through an extruder in which each wire passes through an extrusion head in which the guide and sizing extrusion dies are located, said dies determine final diameter which is obtained when the solid or foam insulation with solid layer protection is extruded through said extruder existing in the process line towards the extrusion dies; c) the eccentricity level between each conductor and the applied insulation is 10% maximum.

9. A manufacturing method for the multipurpose cable for outside telecommunications according to claim 8, characterized because the pairing lays of VVDD cables with fewer than 10 pairs is conducted separately and then the pairs are cabled to obtain a DINA configuration, being said pairing pitches nearly closed and cabled, selected in such a way that the electromagnetic induction (NEXT) between pairs of the same group or between pairs of different groups or sectors is minimized to provide higher electric performance, especially in NEXT.

10. A manufacturing method for the multipurpose cable for outside telecommunications according to claim 8, characterized because in the pairing-cabling step of cables consisting of a number of pairs equal or greater than 10, the insulated conductors are assembled in pairs with practically closed pairing lays to ensure a high electrical performance of the cable, especially with regard to NEXT parameter between pairs of a same group or between pairs of different groups or sectors, and after the formation of the pairs, said pairs are grouped in 10-pair sectors, in the case of cables consisting of up to 100 pairs or in 50-pair groups (10-pair sectors) in the case of cables consisting of between 150 and 600 pairs; and then the sectors or groups are guided through an assembling device to be cabled and to form the final core assembly.

11. A manufacturing method for the multipurpose cable for outside telecommunications according to claim 8, characterized because when the cables are filled, the cable core is impregnated with jelly filling material through immersion, and the application of low and medium density polyolefin based outside cover is conducted in an extruder through guides and extrusion dies according to the required dimensions of the cable; moreover, if it is requested prior to the application of the outside cover, the shielded core is impregnated with a flooding compound to prevent water and moisture penetration in the cable and to reduce metal shield corrosion.

* * * * *